United States Patent [19]

Missier

[11] Patent Number: 4,688,518

[45] Date of Patent: Aug. 25, 1987

[54] POWDER DISTRIBUTOR FOR ELECTROSTATIC PAINTING

[76] Inventor: Gabriele Missier, V.le P.ta Vercellina, 14, 20123 Milano, Italy

[21] Appl. No.: 833,914

[22] Filed: Feb. 26, 1986

[30] Foreign Application Priority Data

Mar. 8, 1985 [IT] Italy ..... 19838 A/85

[51] Int. Cl.[4] ..... B05B 5/04

[52] U.S. Cl. ..... 118/626; 118/629; 118/308; 118/323; 239/223; 239/692

[58] Field of Search ..... 118/626, 629, 308, 323; 239/692, 703, 223

[56] References Cited

U.S. PATENT DOCUMENTS 3,916,826 11/1975 Knudsen ..... 118/629

4,044,717 8/1977 Provost ..... 118/629

*Primary Examiner*—Shrive P. Beck

*Attorney, Agent, or Firm*—Toren, McGeady & Associates

[57] ABSTRACT

The present invention relates to a powder distributor for electrostatic painting provided with reciprocating vertical movement, wherein the powder in mixture with air reaches the center of a sectional element, for example a disk, which disperses it evenly over its perimetral rim.

The distributor comprises a reservoir divided into two chambers by an intermediate porous septum, a first, upper chamber into which a first, powder-in-air suspension feed circuit debouches, and a second, lower chamber into which a second, compressed air feed conduit debouches. Provision can also be made for a third conduit, for compressed air feed, the compressed air being in such case discharged parallel to the direction of discharge of the powder suspension.

4 Claims, 7 Drawing Figures

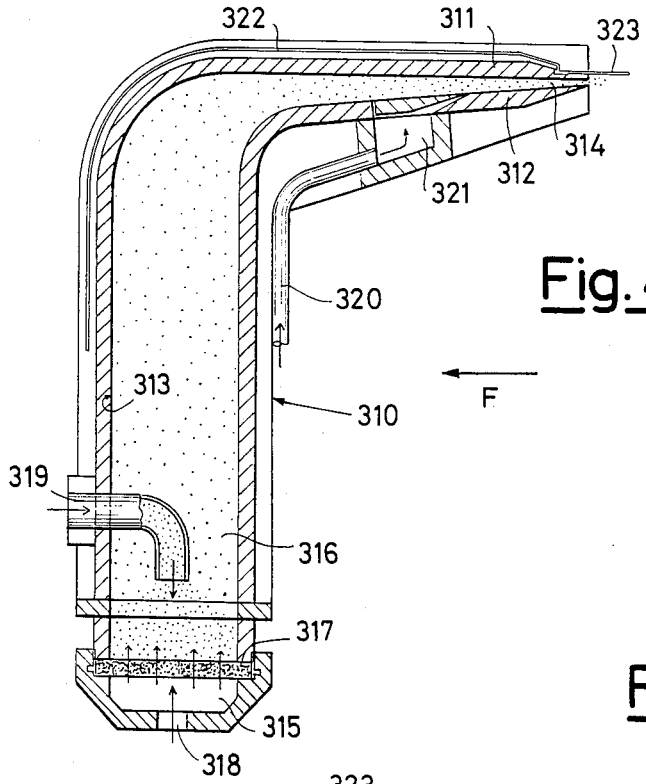
Fig. 4
Fig. 5
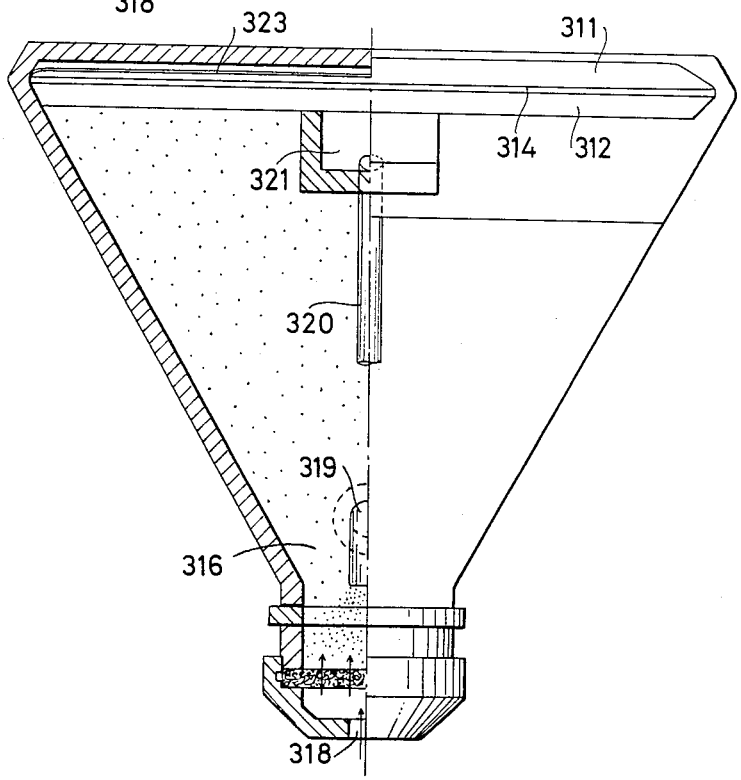

POWDER DISTRIBUTOR FOR ELECTROSTATIC PAINTING

Powder distributor for electrostatic painting are known which comprise a disk connected to one pole of an electrostatic generator so that the very small grains of powder which detach from the rim of the disk possess an electric charge as a result of the corona round said rim, and are attracted by the workpiece to be painted, which is connected to the opposite pole of the generator, which is earthed.

Compressed air or some other mechanical means is used to send the powder onto the disk.

More specifically, such distributor comprise an upper disk and a lower disk between which the powder is fed; under the action of compressed air the powder is discharged to the outside through an interspace between the disks. The path followed by the powder from the feed conduit to the circumerential outlet of the disk is somewhat tortous, which fact causes not readily controllable pressure drops which in turn give rise to non-homogeneity of the suspension and difficulty in regulating the flow-rate of the powder-in-air suspension.

The object of the present invention is to obviate these drawbacks by embodying a distributor in which the powder-in-air suspension is homogeneous at all the discharge points and flow rate is adjustable with precision, as is highly desirable.

To attain this object the present invention embodies a distributor consisting of two surfaces so distanced that they form a hollow space which communicates with a reservoir to which a powder-in-air suspension is fed through a first central conduit, said reservoir being divided into two chambers by an intermediate porous septum; a first, upper chamber into which said first, suspension feed conduit debouches; and a second, lower chamber into which a second, compressed air feed conduit debouches.

The said hollow space can also communicate with a third conduit for compressed air discharged parallel to the direction of discharge of the powder suspension.

The structural and functional characteristics of the invention, and its advantages over the known art, will become more apparent from the following exemplifying description referred to the appended drawings, in which:

FIGS. 2, 3 and 4 are sections as in FIG. 1, but illustrating further, different forms of embodiment of the invention;

FIG. 5 is a view taken on the arrow F in FIG. 4, partially transectioned and sectioned;

Figure 1:
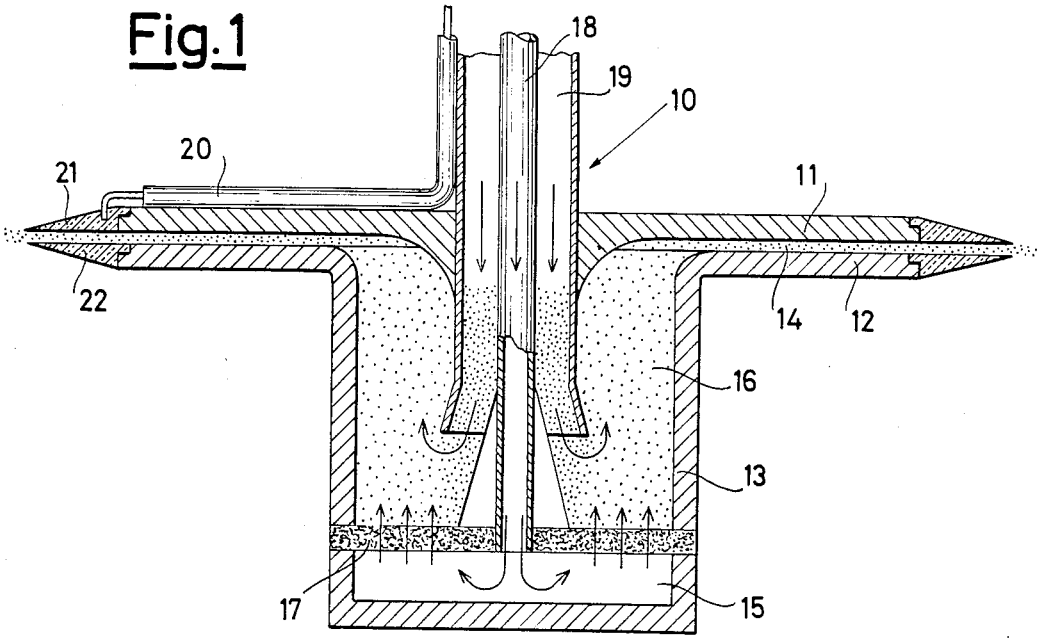
FIG. 1 is a vertical sectional view illustrating a distributor embodied according to the invention.

With reference to FIG. 1 of the drawings, the distributor in question is indicated overall by 10 and consists structurally of, for example, two disks 11, 12, upper and lower respectively, and of a cylindrical reservoir 13 solid with the lower disk 12. The disks 11, 12 can also be embodied as non-circular plates. As is clearly shown in FIG. 1, the disks 11, 12 are so distanced as to form a hollow space 14 which communicates directly with the reservoir 13.

Internally, the reservoir 13 is divided into two chambers 15, 16 by an intermediate porous septum 17. A first conduit 18 for compressed air feeding debouches into the chamber 15, which conduit is housed within a second conduit 19 for feeding the powder-in-air suspension contained in the chamber 16. These two conduits are coaxial with each other and with the reservoir 13.

In consequence the compressed air coming from the conduit 18 fills the chamber 15 and passes through the porous septum and enters the chamber 16 in up-flow with respect to the powder-in-air suspension coming from the annular conduit 19. As a result, the suspension is distributed evenly throughout the chamber 16 and forced homogeneously to the outside through the hollow space 14.

It is thus evident that the aforesaid feeding of compressed air in up-flow with respect to the suspension not only facilitates in even distribution of the suspension within the chamber 16 but also allows fine regulation of the powder-in-air concentration. The numeral 20 indicates a high-insulation cable connecting the high-voltage generator and the electrodes 21 and 22.

Figure 2:
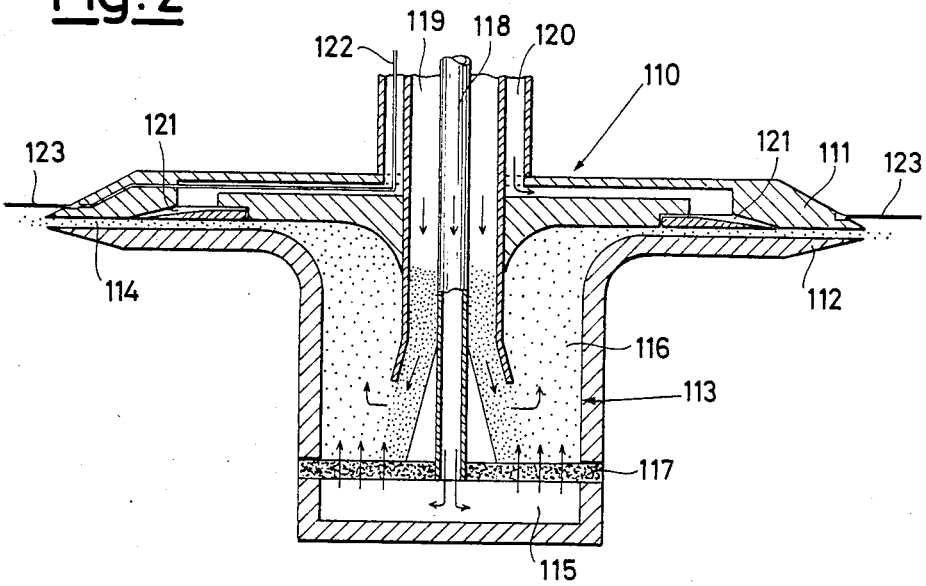

In the different form of embodiment of the present invention shown in FIG. 2, components identical or equivalent to those in FIG. 1 are indicated by the same reference numerals increased by 100.

In this form of embodiment provision is made for a third variable section annular conduit 120 which carries compressed air to a discharge manifold 121, which is also annular and of variable section, situated in the empty space 114, where said air discharges parallel to the faces of the disks 111, 112 and provides an improved and uniform distribution of the powder suspension, especially when the throughputs of said powder are relatively high and when the materials are not easily accessible.

Figure 3:
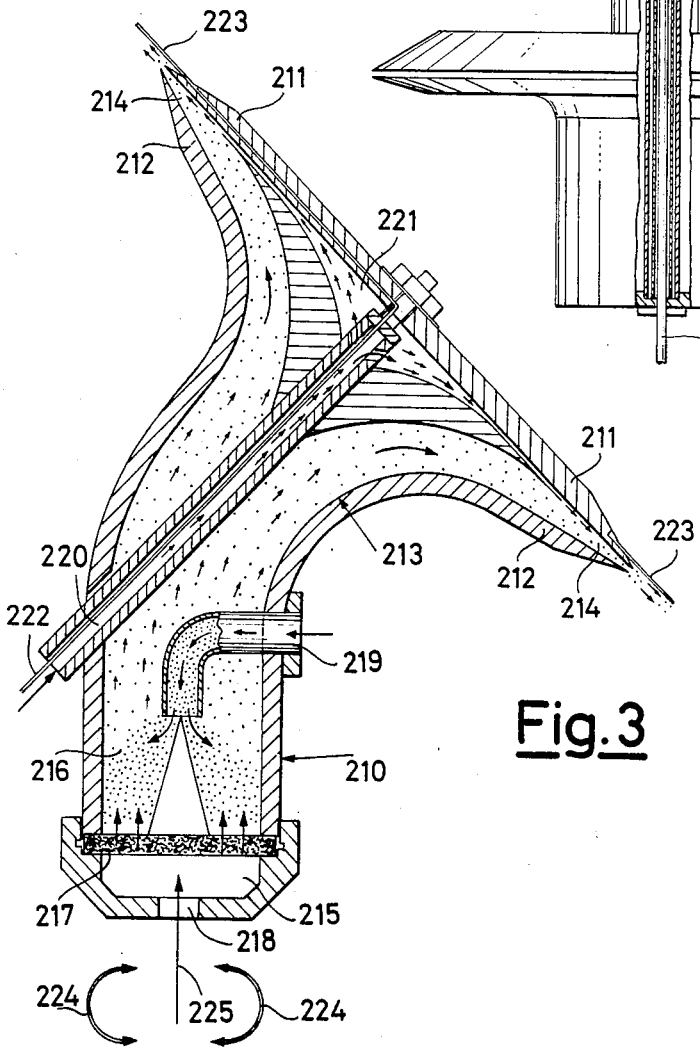

In the further form of embodiment shown in FIG. 3, components identical or equivalent to those in FIG. 1 are indicated by the same reference numerals increased by 200.

In FIG. 3, a distributor indicated overall by 210, of disk type, consists structurally of two disks 211 and 212, upper and lower respectively, disposed obliquely to a reservoir 213.

As is clearly shown in FIG. 3, the disks 211, 212 are distanced from each other so as to form a hollow space 214 communicating directly with the reservoir 213. Internally, the reservoir 231 is divided into two chambers 215, 216 by an intermediate porous septum 217.

Debouching coaxially therewith the chamber 215 is a first compressed air feed conduit 218 which evenly distributes a powder suspension conveyed into the chamber 216 by a second conduit 219.

The conduit 219 enters the chamber 216 radially, and axially discharges the powder suspension in up-flow with respect to the air coming from the conduit 218.

A third conduit 220 disposed in a normal position with respect to the disks 211, 212, conveys air to an essentially conical discharging chamber 221 which conveys it into the terminal portion of the hollow-space 214, thus improving the distribution of the powder suspension. This distributor rotates about itself and is suitable for the painting of hollow bodies.

In the further form of embodiment of the present invention shown in FIG. 4, components identical or equivalent to those in FIG. 1 are indicated by the same reference numeral increased by 300. In FIG. 4, a distributor indicated by 310 structurally consists in its terminal portion of two, upper and lower, faces 311, 312, disposed normally with respect to a reservoir 313. As the faces 311, 312 are distanced from each other, they form a hollow space 314 which imparts the discharge direction to the powder suspension. Internally, the reservoir 313 is divided into two chambers 315, 316 by an intermediate porous septum 317.

The first chamber 315 features a first conduit 318 for feeding compressed air which, after passing through the porous septum 317 evenly distributes a powder suspension fed by a second conduit 319. The conduit 319 debouches radially into the chamber 316 and axially discharges the powder suspension in up-flow respect to the direction of the air coming from the conduit 318.

A third conduit 320 extends along the external part of the distributor and conveys air to a discharge chamber 321 formed in the lower face 312 in the area of the hollow space 314, assisting in better directing the discharge of the powder suspension.

Figure 6:
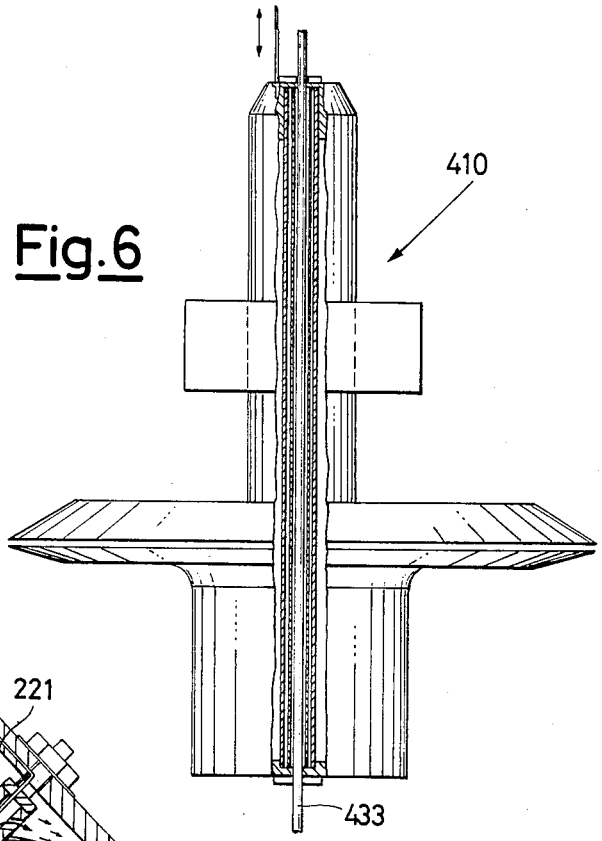
FIG. 6 is a partially sectioned elevational view illustrating a possible guide system within a painting booth for a distributor according to the invention.
Figure 7:
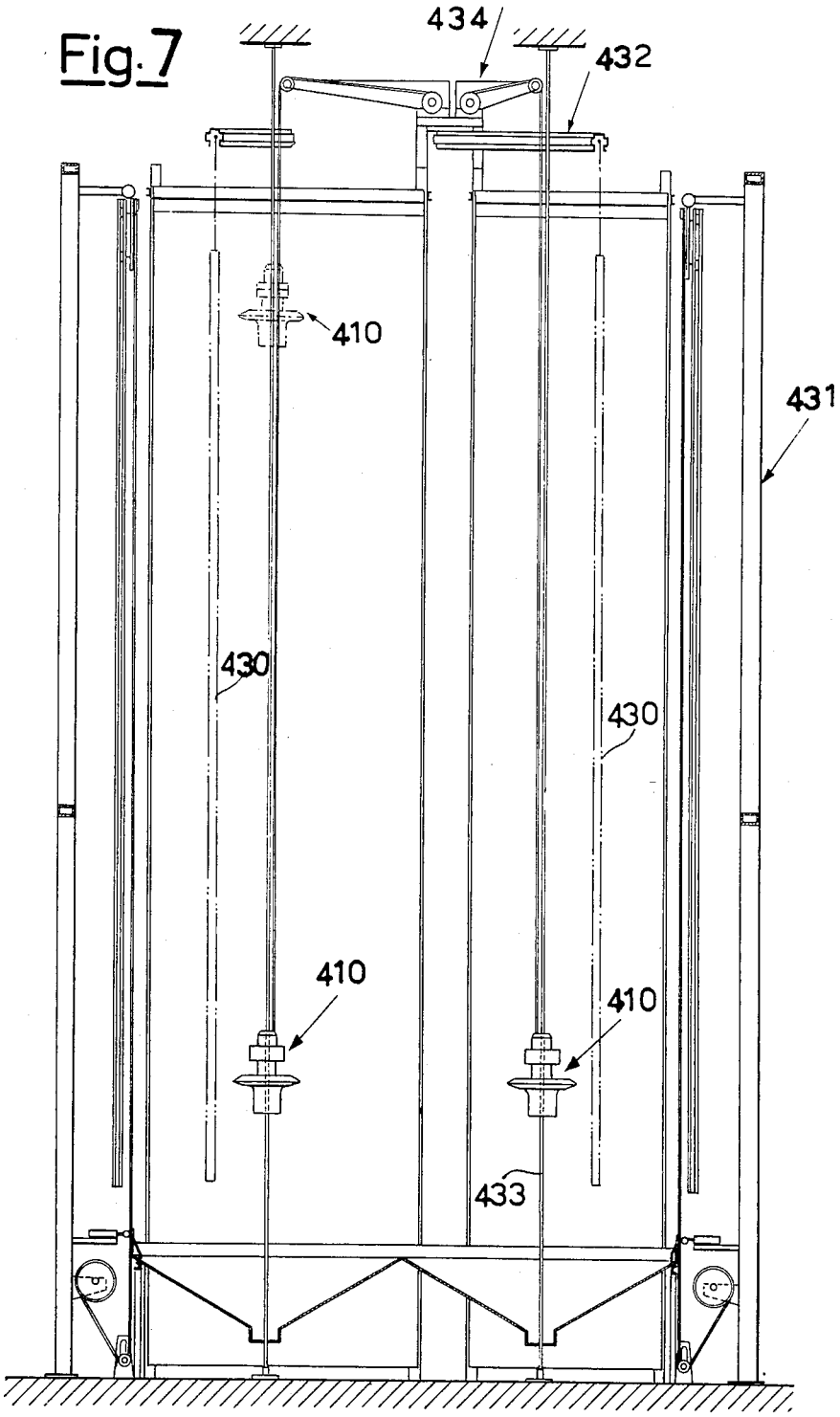
FIG. 7 shows the distributor in FIG. 6 guided within a painting booth.

FIGS. 6 and 7 show a distributor 410, of discoid form, embodied according to the principles of the present invention, which requires to be provided with reciprocating vertical movement in order to effect the complete painting of products 430, which are fed to the interior of a painting booth 431 by a known overhead conveying system 432.

According to the invention, the said reciprocating movement of the distributor 410 is guided through the intermediary of an electrically insulated arm 433 which preferably passes through the body of the distributor 410.

The guide arm 433 extends between the bottom and top of the painting booth and the distributor 410 can thus be simply suspended from a raising and lowering device, such as a moderately powered winch, indicated schematically by 434, in that such device has only to bear the weight of the distributor.

As is clear, the winch can be housed at the summit of the painting booth, thus practically within the same overall dimensions, without calling for large free spaces outside the booth.

If the distributor 410 is of the circular type shown, the guide arm 433 can advantageously be passed axially through a tubular sleeve 435, as illustrated in the particular in FIG. 6.

In this way there is solved the problem of painting products of considerable height, as for example the metal girders used in the building trade to erect the framework of buildings. Girders of this type reach a height of 7 meters and more, and if conventional distributor movement systems were used to paint large spaces outside the painting booth would be required.

I claim:

1. A distributor of powder for electrostatic painting, consisting of two surfaces distanced so that they form a hollow space which communciates with a reservoir to which is fed a powder-in-air suspension through a first central conduit, said reservoir being divided into two chambers by an intermediate porous septum; a first, upper chamber into which said suspension feeding first conduit debouches; and a second, lower chamber into which a second, compressed air feeding conduit debouches, and said two conduits are coaxial and inserted one within the other.

2. A distributor of powder for electrostatic painting, consisting of two surfaces distanced so that they form a hollow space which communicates with a reservoir to which is fed a powder-in-air suspension through a first central conduit, said reservoir being divided into two chambers by an intermediate porous septum; a first, upper chamber into which said suspension feeding first conduit debouches; and a second, lower chamber into which a second, compressed air feeding conduit debouches, and a third conduit for compressed air, such air being discharged parallel to the direction of discharge of the powder suspension, debouches into said hollow space.

3. A distributor of powder for electrostatic painting, consisting of two surfaces distanced so that they form a hollow space which communicates with a reservoir to which is fed a powder-in-air suspension through a first central conduit, said reservoir being divided into two chambers by an intermediate porous septum; a first, upper chamber into which said suspension feeding first conduit debouches; and a second, lower chamber into which a second, compressed air feeding conduit debouches, and the parallel surfaces forming the hollow space are disks disposed normally with respect to the reservoir.

4. A distributor of powder for electrostatic painting, consisting of two surfaces distanced so that they form a hollow space which communicates with a reservoir to which is fed a powder-in-air suspension through a first central conduit, said reservoir being divided into two chambers by an intermediate porous septum; a first, upper chamber into which said suspension feeding first conduit debouches; and a second, lower chamber into which a second, compressed air feeding conduit debouches, and the parallel surfaces forming the hollow space are disks disposed obliquely with respect to the reservoir.

* * * * *